US008111852B2

(12) United States Patent
Ho et al.

(10) Patent No.: US 8,111,852 B2
(45) Date of Patent: Feb. 7, 2012

(54) HEARING AID WITH COMPONENT MOUNTED IN THE HOUSING BY A DAMPING CLIP

(75) Inventors: Wai Kit David Ho, Singapore (SG); Wee Haw Koo, Singapore (SG); Beng Hai Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 834 days.

(21) Appl. No.: 12/169,721

(22) Filed: Jul. 9, 2008

(65) Prior Publication Data

US 2009/0016553 A1 Jan. 15, 2009

(30) Foreign Application Priority Data

Jul. 9, 2007 (DE) ..... 10 2007 031 872

(51) Int. Cl.
*H04R 25/00* (2006.01)

(52) U.S. Cl. ..... 381/324; 381/322

(58) Field of Classification Search ..... 381/415, 381/324, 322, 392, 368
See application file for complete search history.

(56) References Cited

U.S. PATENT DOCUMENTS

| | | | | |
|---|---|---|---|---|
| 4,854,415 | A * | 8/1989 | Goschke | 181/130 |
| 5,204,917 | A | 4/1993 | Arndt et al. | |
| 6,993,144 | B1 * | 1/2006 | Wilson et al. | 381/380 |
| 7,181,035 | B2 * | 2/2007 | van Halteren et al. | 381/322 |
| 7,190,803 | B2 * | 3/2007 | van Halteren | 381/398 |
| 7,471,805 | B2 * | 12/2008 | Goldberg | 381/415 |
| 7,657,048 | B2 * | 2/2010 | van Halteren et al. | 381/322 |
| 7,668,327 | B2 * | 2/2010 | Sluppke | 381/324 |
| 2004/0141627 | A1 * | 7/2004 | Paczkowski | 381/324 |
| 2004/0247149 | A1 * | 12/2004 | Sorensen | 381/328 |
| 2006/0034473 | A1 * | 2/2006 | Halteren et al. | 381/322 |
| 2007/0036381 | A1 | 2/2007 | Klemenz et al. | |
| 2009/0060241 | A1 * | 3/2009 | Saltykov et al. | 381/324 |
| 2009/0248086 | A1 * | 10/2009 | Parker | 606/300 |

FOREIGN PATENT DOCUMENTS

| | | |
|---|---|---|
| DE | 1 160 504 | 1/1964 |
| WO | WO 2007/398897 | 4/2007 |

* cited by examiner

*Primary Examiner* — Steven Loke
*Assistant Examiner* — David Goodwin
(74) *Attorney, Agent, or Firm* — Shiff Hardin LLP

(57) ABSTRACT

A hearing aid has at least one converter element which, in order to reduce mechanical vibrations, is flexibly attached inside or at the hearing aid housing. The converter is mounted in the housing by at least one clip that flexibly is moveable or displaceable in its range of action like a spring, in order to damp and attach the converter element.

7 Claims, 7 Drawing Sheets

HEARING AID WITH COMPONENT MOUNTED IN THE HOUSING BY A DAMPING CLIP

BACKGROUND OF THE INVENTION

Field of the Invention

The present invention concerns a hearing aid of the type having at least one converter element mounted in the hearing aid housing in a mounting arrangement that reduces transfer of mechanical vibrations to the converter element.

From EP 0 453 200 B1, a hearing aid is known in which the microphone is contained in a separate enclosure which is mounted in the overall hearing aid housing aid via several flexible projections.

From WO 2007/1038897 A2, a miniature electronic device such as a hearing aid is known in which an elastic or flexible holding element is arranged in a receptacle along parts of the inside wall of the receptacle, in order to damp electronic components. The holding element has inward projecting holding areas in order to hold an electronic component or keep it in position.

From DE 1 160 504, a suspension attachment for a transmission system for use in electroacoustic devices, for example, hearing aids. The transmission system is surrounded by several tube-like parts by means of which it is separated from the walls of the receptacle. The tube-like parts have non-linear flexible and damping characteristics. This is intended to reduce the influence of mechanical reactions.

From EP 1 750 480 A1, a hearing aid is known that has an ear adapter, a housing part to be worn behind the ear, and a hearing tube connecting the ear adapter with the housing part. In order to avoid mechanical vibrations from being transmitted from the ear adapter to the housing part by the hearing tube, damping elements are provided in the joint areas which absorb mechanical vibrations. In addition, a damping element can be placed at or in the hearing tube.

From EP 0 453 200 A2, a hearing aid with a modular design is known. A microphone of the hearing aid is arranged in a flexible tube. The flexible tube has arm-like suspension elements by means of which they are suspended in a housing.

SUMMARY OF THE INVENTION

An object of the present invention is to attach, in a housing, the converter elements of a hearing aid, such as, microphone, earpiece or telecoil, so that they are acoustically isolated from each other, and/or so that mechanical vibrations caused by the converter elements are reduced in order to improve the reliability of the hearing aid and avoid undesired background noise.

The above object is achieved in accordance with the present invention by a hearing aid having a hearing aid housing that contains a converter element, such as an electroacoustical converter element or an acoustoelectrical converter element, with the converter element being mounted in the housing by a damping clip that is moveable or displaceable within a range effective for damping transfer of vibrations from the housing to the converter element. The damping clip is moveable or displaceable in the manner of a spring in order to achieve the aforementioned damping effect. The damping clip also serves to attach the converter element to the housing.

The flexibly designed damping clip for the converter elements of the hearing aid causes the converter elements to be mounted flexibly inside the hearing aid. Besides improving the functional properties of the hearing aid by reducing mechanical vibrations caused by the converter element, it is also insured that mechanical deformations at the housing of the hearing aid do not damage the components.

Preferably, the damping clip has two disc-shaped elements between which a spring element is located. To one of the two disc-shaped elements, the converter element is attached. The other disc-shaped element is attached to, or supported by, the inside wall of the hearing aid housing.

Advantageously, the spring element is formed of multiple (preferably three) resilient clasps that are attached to the respective disc-shaped elements by means of their two arms.

In order to attach the converter element to the damping clip and to retain the damping clip to the hearing aid housing, at least one outside wall of the two disc-shaped elements is equipped in a simple way with double-sided adhesive tape.

An effective attachment of the microphone can be achieved by holding the microphone between two damping clips that are both supported at the inside wall of the hearing aid housing.

DESCRIPTION OF THE PREFERRED EMBODIMENTS

Figure 1A:
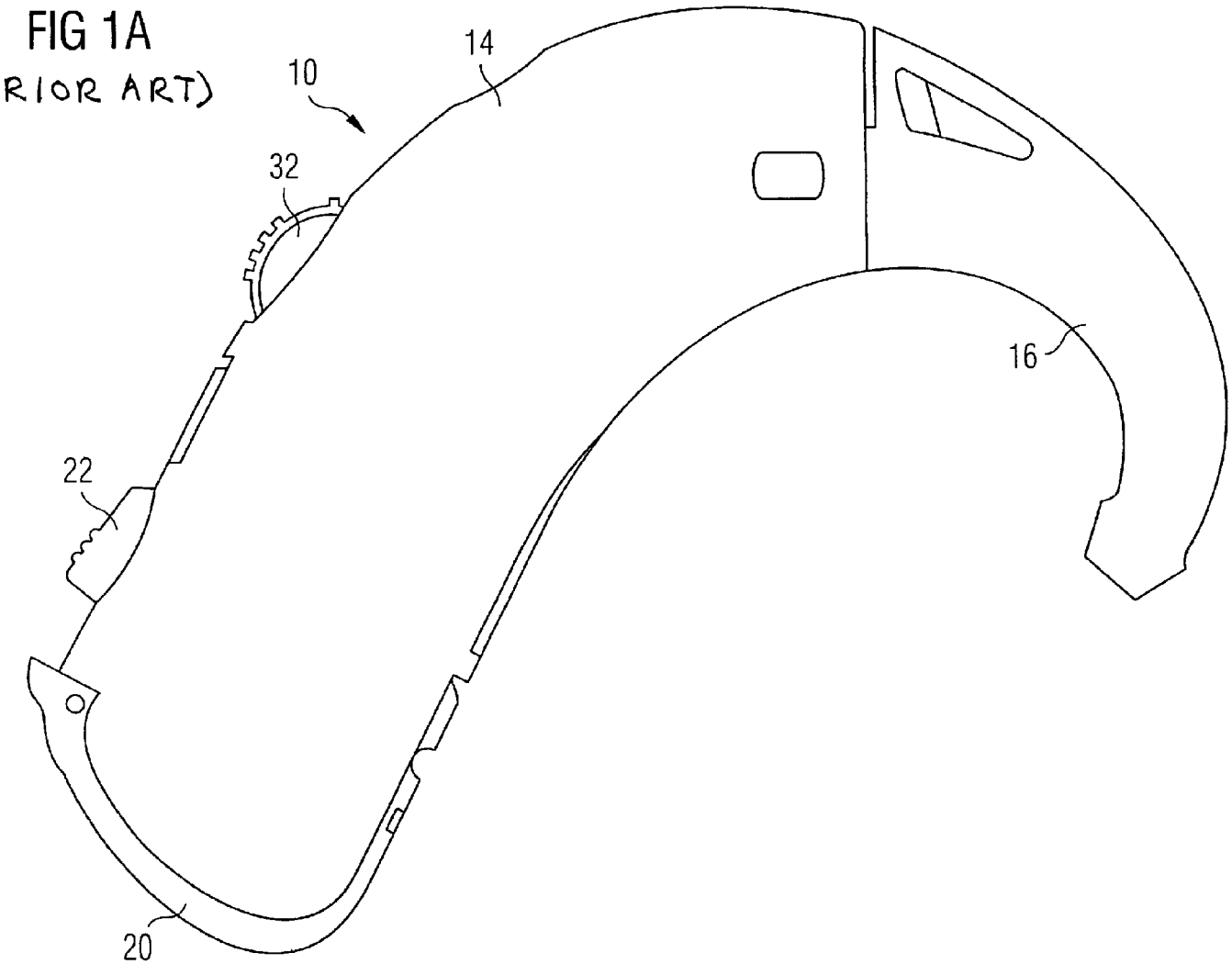
FIG 1A (PRIOR ART)
FIG. 1A is an exterior view of a conventional behind-the-ear hearing aid.
Figure 1B:
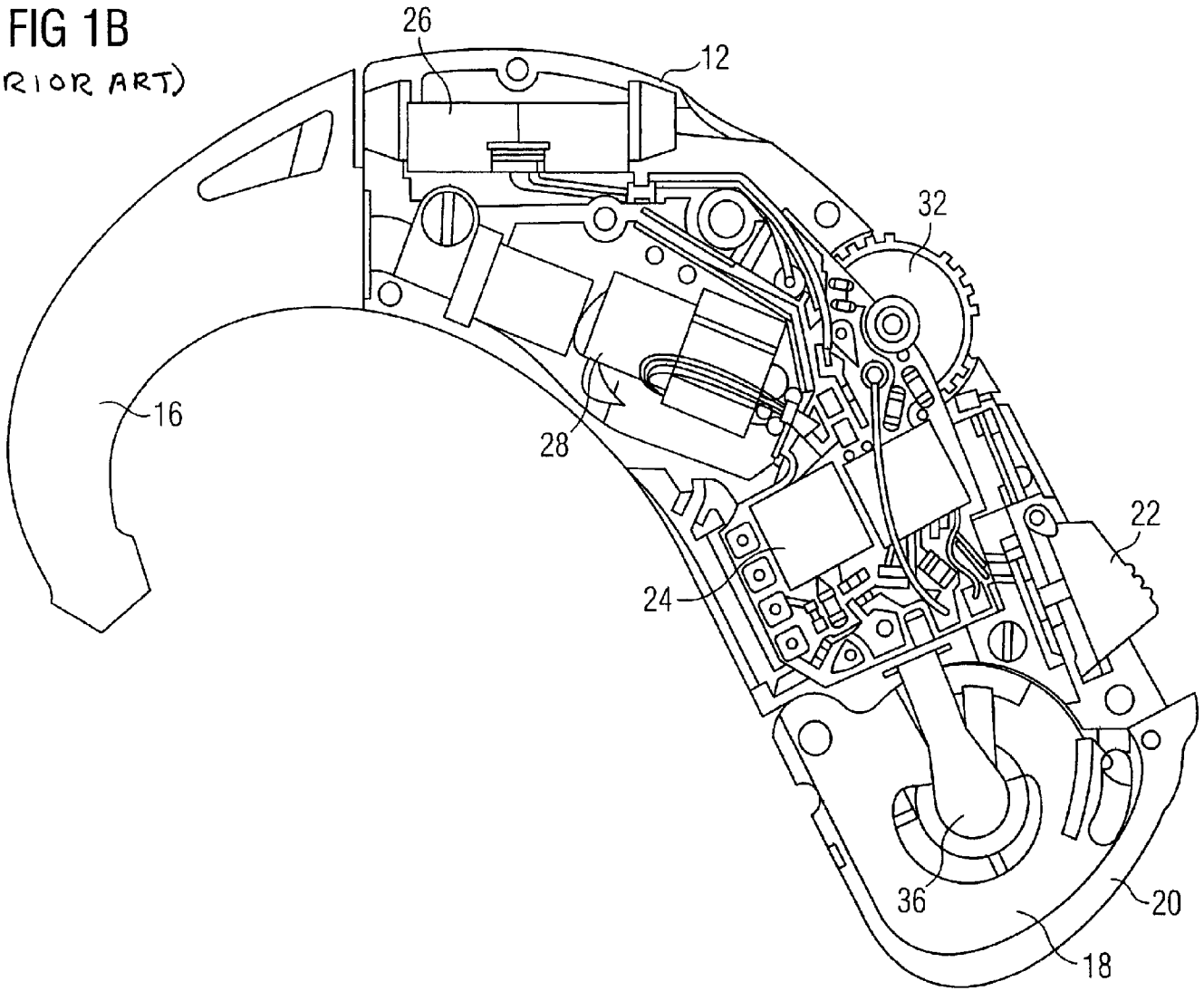
FIG 1B (PRIOR ART)
FIG. 1B shows the hearing aid of FIG. 1A with the cover removed to expose internal components thereof.

Subsequently, the hearing aid 10 shown in FIGS. 1A and 1B is explained only with regard to the damping or attachment means provided for the converter elements of the hearing aid.

The hearing aid 10 has a shell-like housing bottom 12 and a shell-like cover 14. In order to be able to wear it at the ear, one end of the housing has a bow end piece 16.

In order to receive a power supply, in particular a battery, the housing provides a battery case 18, which is designed to be located behind a cover 20 formed as a swivel-mounted flap for the purpose of exchanging batteries. The embodiment provides a sliding switch 22 to activate the hearing aid 10 (microphone mode), to switch to telephone mode and to deactivate the hearing aid 10.

Figure 2:
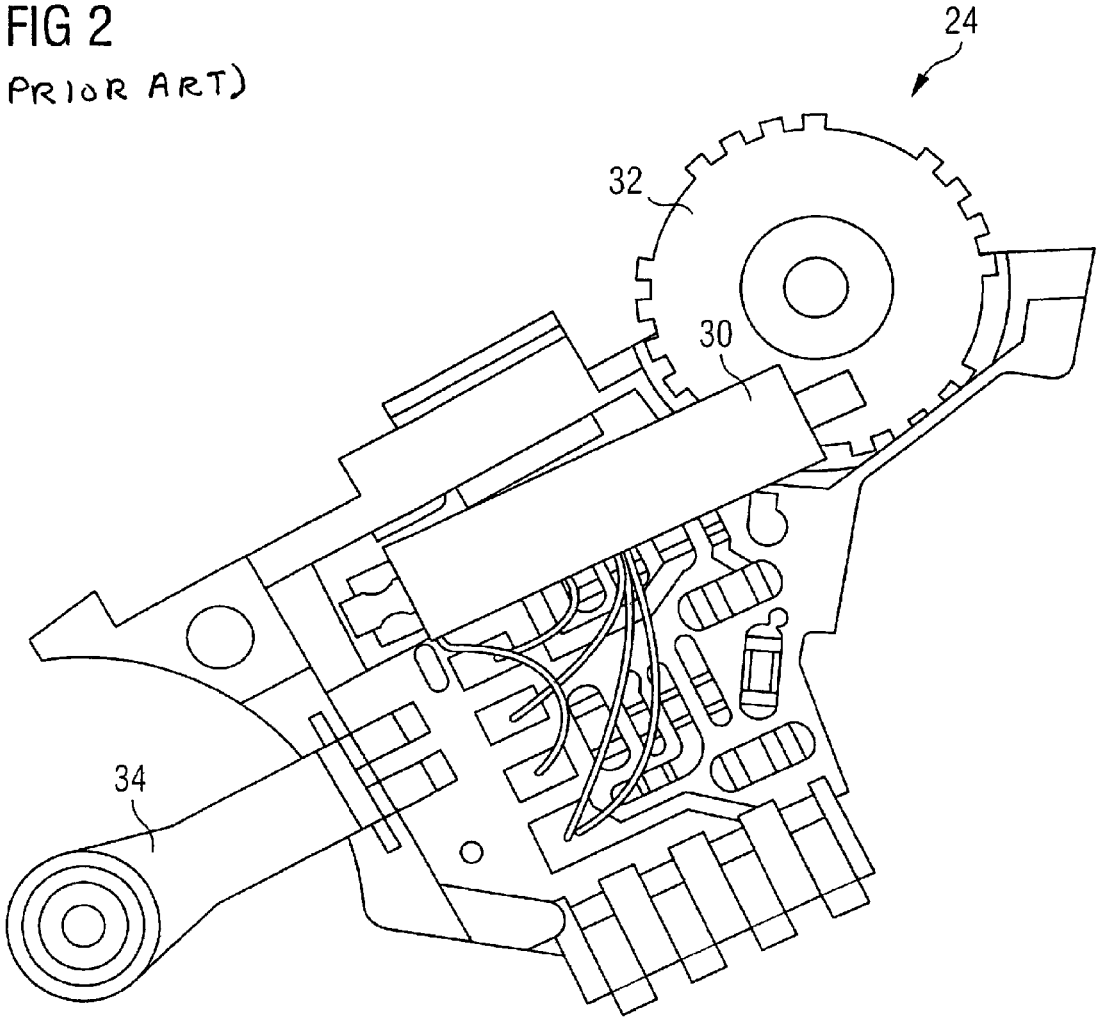
FIG 2 (PRIOR ART)
FIG. 2 shows the amplifying unit of the hearing aid of FIGS. 1A and 1B.

Most of the different components of the hearing aid 10 are located in the housing bottom 12, which basically includes an amplifying unit 24 (shown separately in FIG. 2), a microphone unit 26, an earpiece (speaker) 28, as well as a telecoil 30. The telecoil serves the purpose of making even magnetic signals sound-perceptible to the listener. A hand wheel 32 projecting from the housing is part of a potentiometer serving for volume control. Battery contacts are referenced 36.

Figure 3:
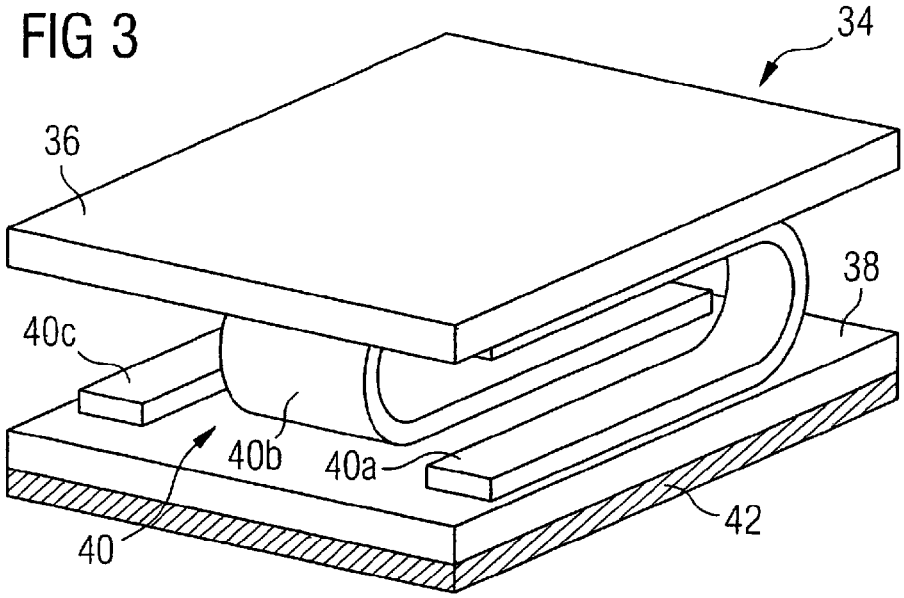
FIG. 3 is a perspective view of an embodiment of an inventive damping clip.

FIG. 3 and the following figures describe and explain the damping or attachment arrangement which can be used selectively for the converter elements microphone 26, the earpiece 28 and the telecoil 30. The damping arrangement includes a damping clip 34 that includes two disc-shaped elements 36 and 38 with a spring element 40 attached between them. The spring element 40 is formed by three flexible clasps 40*a*, 40*b*, and 40*c* whose arms are attached to the inside wall of the disc-shaped element 36, 38. Preferably, the clasps 40*a*, 40*b*, and 40*c* are made of rubber or malleable plastic, but it is possible to use other flexibly malleable materials. The clasps 40*a*, 40*b*, and 40*c* can also be made in one piece. In order to attach the converter element to the damping clip 34, one of two disc-shaped elements 36 and 38 can be provided with double-sided adhesive tape 42. If required, it is also possible to provide the other disc-shaped element 36, 38 with such adhesive tape 42 in order to achieve a secure fixation of the damping clip 34 to the inside wall of the housing. It is also possible to provide a different kind of attachment.

Figure 4:
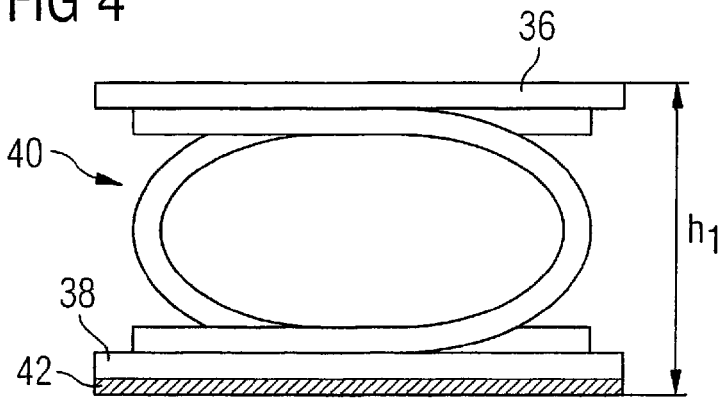
FIG. 4 is a side view of the damping clip in unloaded condition.
Figure 5:
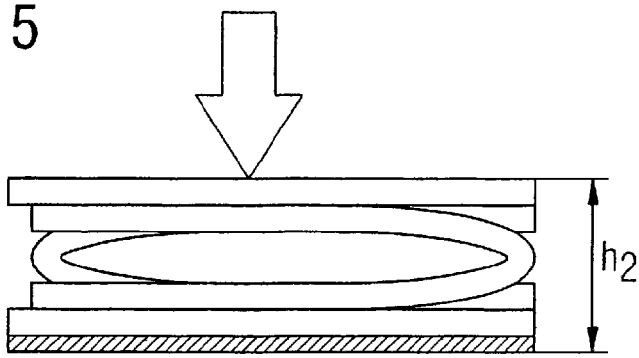
FIG. 5 is a side view of the damping clip in loaded or compressed condition.

FIG. 4 shows the damping clip 34 in unloaded condition and FIG. 5 shows it in loaded or compressed condition. It can be seen that the damping clip 34 is able to deform flexibly under pressure, so as to effectively damp mechanical vibrations of the microphone unit 26 as well as to prevent the microphone to be destroyed and damaged in case of mechanical deformation of the housing.

Figure 6:
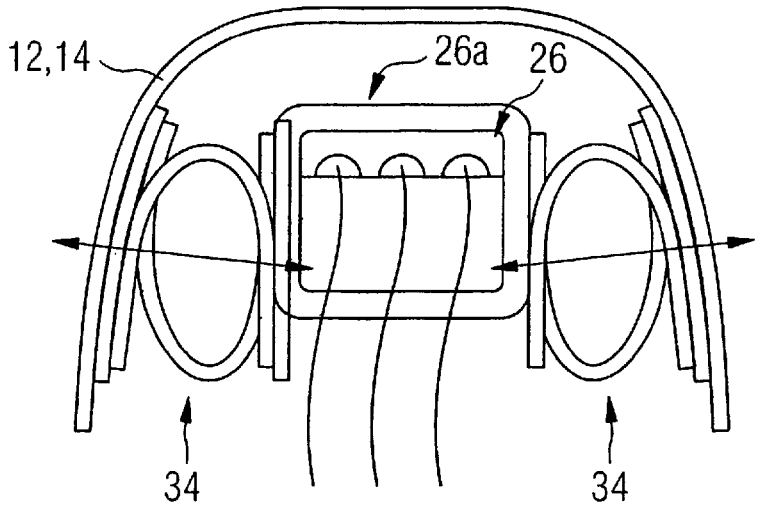
FIG. 6 shows an inventive damping arrangement for a microphone having two damping clips.

FIG. 6 shows a different damping or attachment arrangement for the microphone unit 26. To this end, two damping clips 34 are used that have the housing 26*a* of the microphone unit 26 flexibly stored between them. Both damping clips 34 are supported at the inside wall of the hearing aid housing 12, 14.

Figure 7:
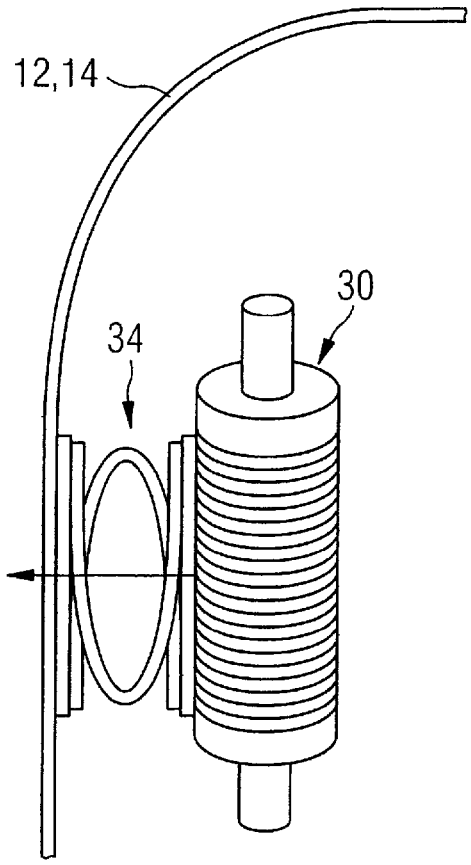
FIG. 7 shows an inventive damping arrangement for a telecoil of a hearing aid.

FIG. 7 shows a second embodiment for the attachment of the telecoil 30. Here the damping clip 34 is attached to the inside wall of the housing by means of the adhesive tape 42. Analogous to the first embodiment, also in this case, mechanical vibrations are effectively dampened by means of flexible damping clips 34.

Figure 8:
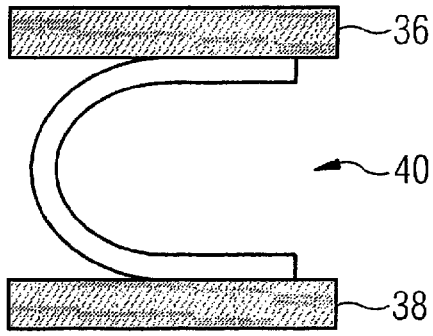
FIGS. 8-14 respectively show further embodiments of the damping clip in accordance with the invention.
Figure 9:
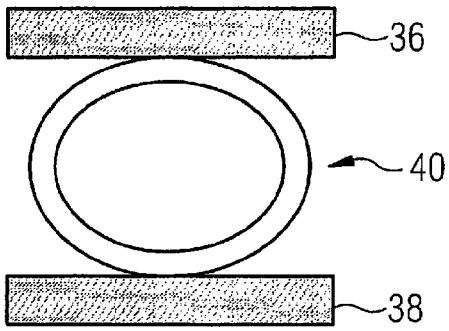
Figure 10:
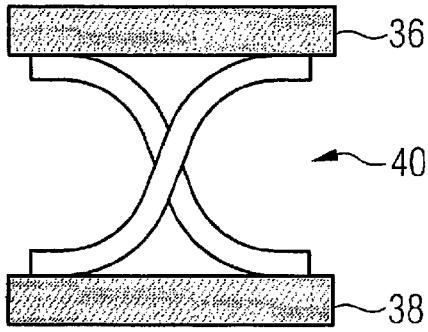
Figure 11:
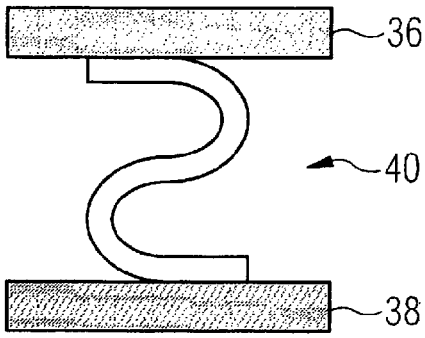
Figure 12:
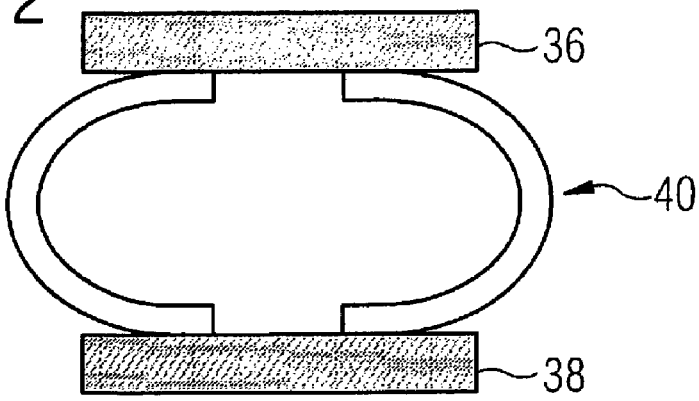
Figure 13:
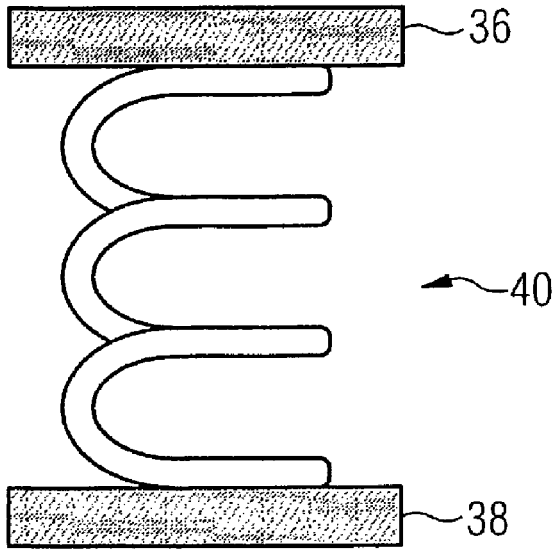

FIGS. 8 through 13 show further embodiments of the damping clip which differ from one another especially regarding the spring element 40. In their basic structure, the disc-shaped elements 36, 38 do not differ from the previously described embodiments. In FIG. 8, the spring element simply has a U-shaped design. In FIG. 9, it has a ring-shaped design. In FIG. 10, it is double S-shaped, in FIG. 11, single S-shaped, in FIG. 12, double U-shaped and in FIG. 13, coil spring-shaped.

Figure 14:
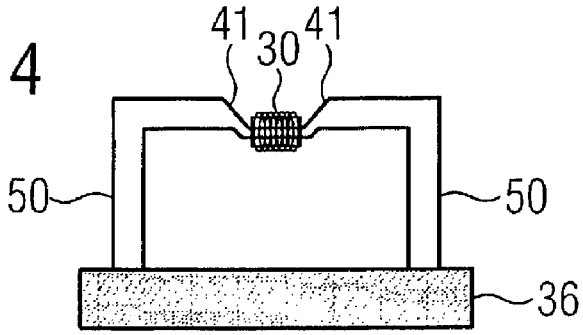

FIG. 14 shows an embodiment of a damping clip having modified spring elements 41. The example shows only disc-shaped element 36. Two support arms 50 are arranged on the disc-shaped element 36. The support arms 50 each have a resilient suspension 41. The suspensions 41 are conveniently tapered and curved into an S-shape in order to produce the desired flexibility. The suspensions 41 flexibly carry the telecoil 30. The desired damping characteristics adjust to the flexibility of the suspensions 41. With regard to the damping characteristics, the flexibility of the suspensions 41 plays the same role as the flexibility of the spring element in the embodiments described above.

The damping arrangements described in the respective arrangements are not limited to the embodiment of the hearing aid described. They can be used in other types of hearing aids, for example, in the so-called "in-the-ear hearing instrument" (ITE).

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing aid comprising:

a hearing aid housing configured to be worn at an ear of a user;

at least one converter element selected from the group consisting of acoustoelectrical converter elements and electroacoustical converter elements;

a damping clip mounting said at least one converter element inside said hearing aid housing and attaching said at least one converter element to said hearing aid housing, said damping clip comprising a spring element having a first side adjacent said hearing aid housing and a second side adjacent said converter element, and one plate-shaped element at said second side between said spring element and said converter element; and said spring element being comprised of flexible material and compressing and expanding said first and second sides relative to each other in a movement range effective to damp transfer of mechanical vibrations from the hearing aid housing to the at least one converter element.

2. A hearing aid as claimed in claim 1 wherein said damping clip comprises two plate-shaped elements and respectively at said first and second sides of said spring element.

3. A hearing aid as claimed in claim 2 wherein said spring element comprises three resilient clasps each having two clasp arms, said resilient clasps being attached to the respective disc-shaped elements at said arms.

4. A hearing aid as claimed in claim 2 wherein said spring element is comprised of a material selected from the group consisting of rubber and plastic.

5. A hearing aid as claimed in claim 2 wherein each of said two plate-shaped elements has a surface facing away from said spring element, and wherein at least one of said disc-shaped elements has double-sided adhesive tape at said surface.

6. A hearing aid as claimed in claim 1 wherein said at least one converter element is a microphone, and wherein said damping clip is a first damping clip, and comprising a second damping clip identical to said first damping clip, said microphone being supported at an inside wall of said hearing aid housing by said first and second damping clips.

7. A hearing aid as claimed in claim 1 wherein said at least one converter element is a telecoil, and wherein said damping clip attaches said telecoil to an interior wall of said hearing aid housing.

* * * * *